US011788380B2

(12) United States Patent
Sharma et al.

(10) Patent No.: US 11,788,380 B2
(45) Date of Patent: Oct. 17, 2023

(54) INSTALLATION OF SLIDING SLEEVE WITH SHIFTING PROFILE IN PASSIVE INFLOW CONTROL DEVICES

(71) Applicant: SAUDI ARABIAN OIL COMPANY, Dhahran (SA)

(72) Inventors: Hemant K. Sharma, Udhailiyah (SA); Abdulrahman K. Mulhim, Udhailiyah (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 51 days.

(21) Appl. No.: 17/451,530

(22) Filed: Oct. 20, 2021

(65) Prior Publication Data

US 2023/0120399 A1 Apr. 20, 2023

(51) Int. Cl.
*E21B 34/14* (2006.01)
*E21B 34/08* (2006.01)

(52) U.S. Cl.
CPC ..... *E21B 34/08* (2013.01); *E21B 2200/06* (2020.05)

(58) Field of Classification Search
CPC ..... E21B 43/32; E21B 34/14; E21B 34/12; E21B 2200/06
See application file for complete search history.

(56) References Cited

U.S. PATENT DOCUMENTS 6,978,840 B2 * 12/2005 Henderson ..... E21B 43/12 166/380
7,409,999 B2 * 8/2008 Henriksen ..... E21B 43/12 166/330
7,762,341 B2 * 7/2010 Hammer ..... E21B 43/12 166/207

(Continued)

FOREIGN PATENT DOCUMENTS

WO 96/34176 A2 10/1996

OTHER PUBLICATIONS

Jalan, Shiv Narayan et al., "Advanced Inflow Control Device in Horizontal Well Extends Economic Field Life: a Case Study and Technological Overview"; Proceedings of the SPE Annual Technical Conference and Exhibition; Paper No. SPE-181403-MS; pp. 1-13; Sep. 26-28, 2016 (13 pages).

(Continued)

*Primary Examiner* — Kenneth L Thompson
(74) *Attorney, Agent, or Firm* — Osha Bergman Watanabe & Burton LLP

(57) ABSTRACT

A method includes monitoring fluid production at a passive ICD installed in a base pipe in a wellbore. Responsive to monitored fluid production meeting one or more predetermined criteria, a remedial sleeve component is installed for the passive ICD. The remedial sleeve component includes: one or more ports which permit throughput of fluid into the base pipe; a closing portion which selectively opens and closes the one or more ports; and one or more sealing (Continued)

portions, which prevent a flow of fluid into the base pipe when the one or more ports are closed. The one or more ports are selectively opened or closed responsive to one or more additional predetermined criteria. A related system includes an actuation tool which deploys into the wellbore to actuate the closing portion to selectively open and close the one or more ports.

19 Claims, 6 Drawing Sheets

(56) References Cited

U.S. PATENT DOCUMENTS

| | | | | |
|---|---|---|---|---|
| 8,596,366 | B2 * | 12/2013 | Franklin | E21B 34/066 166/373 |
| 8,857,516 | B2 | 10/2014 | Ganguly et al. | |
| 9,353,607 | B2 | 5/2016 | Hallundbaek et al. | |
| 9,926,769 | B2 * | 3/2018 | Wood | E21B 33/124 |
| 10,280,709 | B2 * | 5/2019 | Williamson, Jr. | E21B 34/14 |
| 10,472,928 | B2 * | 11/2019 | Andreychuk | E21B 34/14 |
| 10,508,511 | B2 * | 12/2019 | Williamson | E21B 34/14 |
| 11,220,905 | B2 * | 1/2022 | Hunter | E21B 34/06 |
| 11,384,621 | B2 * | 7/2022 | Ring | E21B 34/08 |
| 11,480,030 | B2 * | 10/2022 | Angman | E21B 34/066 |
| 2014/0352956 | A1 * | 12/2014 | Hallundbæk | E21B 43/12 166/254.1 |
| 2016/0153263 | A1 | 6/2016 | Jannise et al. | |
| 2023/0022332 | A1 * | 1/2023 | MacPhail | E21B 43/26 |

OTHER PUBLICATIONS

Al-Jasmi, Ahmad K. et al., "Application of Inflow Control Device Technology and its Value Realization for Kuwait Oil Fields through Best Practices and Multidisciplinary Team Work"; Proceedings of the SPE Annual Technical Conference and Exhibition; Paper No. SPE-166367-MS; pp. 1-15; Sep. 30-Oct. 2, 2013 (15 pages).

* cited by examiner

INSTALLATION OF SLIDING SLEEVE WITH SHIFTING PROFILE IN PASSIVE INFLOW CONTROL DEVICES

BACKGROUND

Conventionally, inflow control devices (ICDs) represent a type of hardware installed permanently upon completion of an oil or gas well, both in new and sidetracked wells, typically horizontal or deviated in each case. Characteristics of their installation are governed by initial reservoir conditions and a simulation-based prediction of reservoir performance.

Generally, an ICD is included as a constituent part of the base pipe of the well completion (e.g., a liner or casing) and defines an inward flow path in a generally radial direction, from a subsurface hydrocarbon reservoir (through which the wellbore and base pipe run) to an interior of the base pipe. The ICD is typically configured to restrict flow through the inward flow path, via additional frictional pressure or the provision of physical impediments (e.g., a tortuous instead of straight flow path). The related purpose is to equalize, as much as possible, inward hydrocarbon flow along the length of the wellbore regardless of location and variation in reservoir permeability. Thus, ICDs permit the entire length of the wellbore to contribute to overall production and optimize hydrocarbon recovery. However, ICDs vary in their capabilities to prevent, mitigate or remediate water production where they are installed, and it remains a challenge to strike an adequate balance between the costs and complexities of initial installation and of any needed remediation.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a method which includes monitoring fluid production at a passive ICD installed in a base pipe in a wellbore. Responsive to monitored fluid production meeting one or more predetermined criteria, a remedial sleeve component is installed for the passive ICD. The remedial sleeve component includes: one or more ports which permit throughput of fluid into the base pipe; a closing portion which selectively opens and closes the one or more ports; and one or more sealing portions, which prevent a flow of fluid into the base pipe when the one or more ports are closed. The one or more ports are selectively opened or closed responsive to one or more additional predetermined criteria.

In one aspect, embodiments disclosed herein relate to a system for modifying a passive ICD installed in a base pipe in a wellbore. A remedial sleeve component includes: one or more ports which permit throughput of fluid in a generally radially inward direction; a closing portion which selectively opens and closes the one or more ports; and one or more sealing portions, which prevent a flow of fluid into the base pipe when the remedial sleeve component is installed in the base pipe and the one or more ports are closed. An actuation tool deploys into the wellbore to actuate the closing portion to selectively open and close the one or more ports.

In one aspect, embodiments disclosed herein relate to a method which includes monitoring water production at a passive ICD installed in a base pipe in a wellbore. Responsive to monitored water production above a predetermined threshold, a remedial sleeve component for the passive ICD is installed via nesting the remedial sleeve component within the base pipe and the passive ICD. The remedial sleeve component includes: one or more ports which permit throughput of fluid into the base pipe, in a generally radially inward direction with respect to the base pipe; a closing portion which selectively opens and closes the one or more ports; and one or more sealing portions, which prevent the throughput of fluid into the base pipe when the one or more ports are closed. The one or more ports are selectively opened or closed responsive to one or more additional predetermined criteria.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
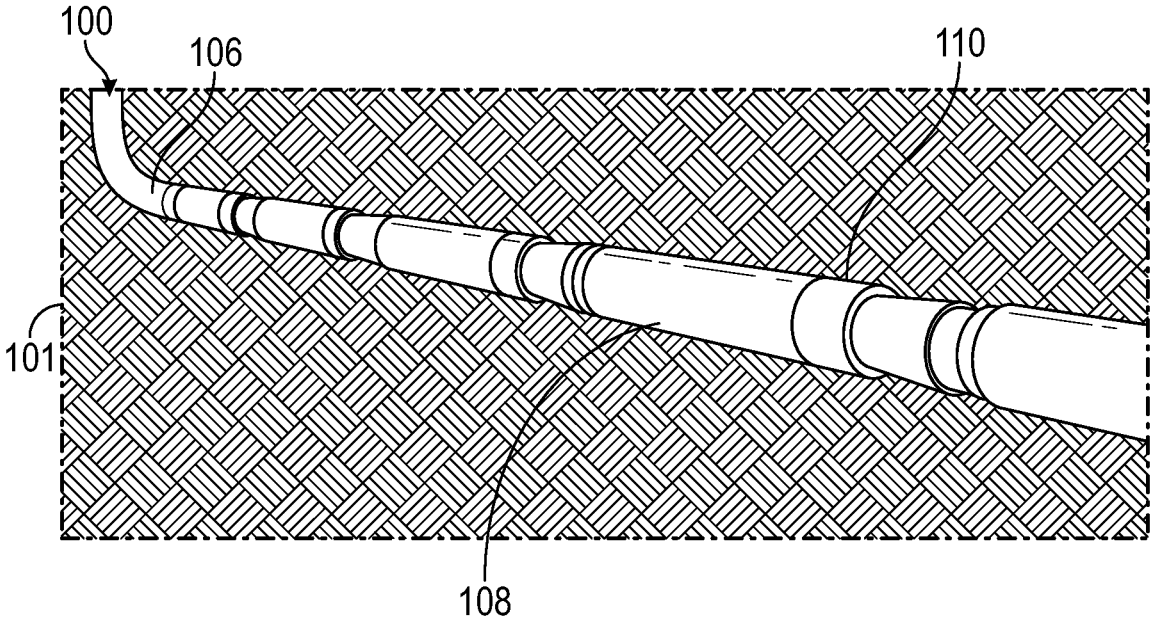
FIG. 1 illustrates, in isometric view, a wellbore base pipe with passive ICDs, by way of general background in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Turning now to the figures, to facilitate easier reference when describing FIGS. 1 through 7, reference numerals may be advanced by a multiple of 100 in indicating a similar or analogous component or element among FIGS. 1-7.

By way of general background in accordance with one or more embodiments, ICDs are usually included as choking or restricting devices for portions of lateral well sections with higher permeability. This helps less permeable portions of the lateral sections contribute more to hydrocarbon production, thus to balance the contributions of different sections along the wellbore. Before the ICDs are installed, wellbore simulation software is typically used to determine the number of ports or channels required in each portion of the wellbore. A resulting completion design for the wellbore will thus determine the need for specific differential pressures at certain flow rates, and this will inform the design and installation of ICDs at given locations along one or more base pipes of the well completion. Highly permeable sections (e.g., involving significant streaks or fractures) are often isolated using openhole packers (e.g., isolation packers) and chemicals. Accordingly, based on the completion design involved, there are two known types of ICDs used frequently for installation: passive and active ICDs.

By way of general background in accordance with one or more embodiments, FIG. 1 illustrates, in isometric view, a wellbore base pipe 100 running through a hydrocarbon reservoir 101 (e.g., a permeable rock formation which yields hydrocarbons for production). The base pipe 100 includes a lateral (or horizontal) section 106. Within this horizontal section, several passive ICDs are disposed, each of which forms a constituent portion of the pipe 100, and one of which is jointly indicated at 108 and 110. As such, in the present illustrative example, each passive ICD includes a permeable portion 108 (which can also be termed a "flow screen") and an isolation packer 110 abutting the permeable portion 108. The isolation packer 110 may be selectively deployed so as to span the full inner diameter of the pipe 100 and thus restrict or block the flow of any fluid through pipe 100 in a generally axial, uphole direction (i.e., in a general direction of right to left, and then up, in the figure).

As such, and as is generally known, a passive ICD such as that shown in FIG. 1 (at 108/110) is always open to fluid production from reservoir 101 and cannot be opened or closed in response to changes in reservoir conditions. In instances where undesirable water production initiates from a specific (passive) ICD, well servicing operations can be performed by isolating the ICD and the section below it (e.g., via isolation packer 110), but this of course will leave much of the recoverable hydrocarbon out of reach, i.e., unable to be recovered. The other option typically pursued is to pull the well completion and recomplete the well based on the noted changes in the reservoir 101, but often this can prove to be very expensive and infeasible.

Figure 2:
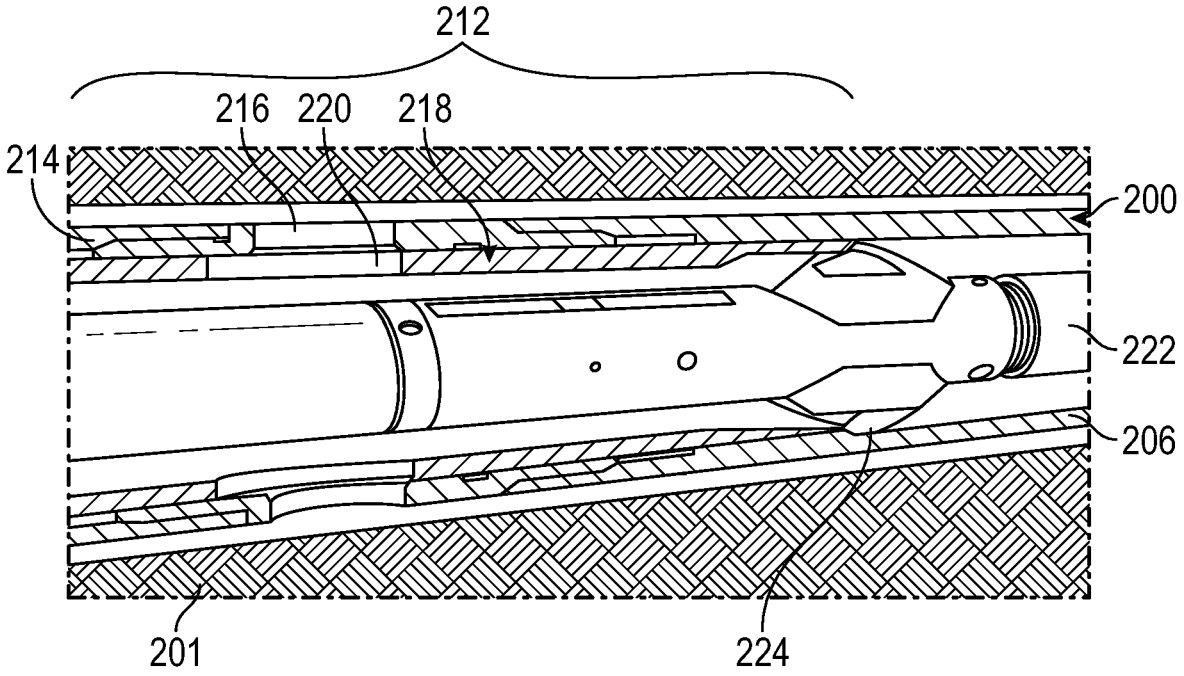
FIG. 2 illustrates, in isometric view, a wellbore base pipe with an active ICD, by way of general background in accordance with one or more embodiments.

On the other hand, also by way of general background in accordance with one or more embodiments, FIG. 2 illustrates, in isometric view, a wellbore base pipe 200 (particularly, a lateral section 206 thereof) running through a hydrocarbon reservoir 201 wherein an active ICD (generally indicated at 212) is installed. As shown, active ICD 212 may include an outer cylindrical portion 214 which may be a constituent portion of (essentially, coincident with) base pipe 200. The outer cylindrical portion 214 includes one or more ports 216 for permitting the throughflow of fluid in a generally radially inward direction from reservoir 201 toward an interior of base pipe 200. Additionally, active ICD 212 includes a sliding sleeve portion 218 nested within outer cylindrical portion 214, which can be slid along an axial direction of base pipe 200, and thus can be axially displaceable relative to outer cylindrical portion 214.

As shown in the illustrative example of FIG. 2, sliding sleeve 218 may include one or more apertures 220 which, when radially aligned with port(s) 216, permits the uninhibited throughflow of fluid from reservoir 201 into the interior of base pipe 200, in a generally radially inward direction; thus, in this position, the active ICD 212 may be considered to be "open". Also, the one or more ports 216 may be selectively closed via the use of a shifting tool 222 which, as shown, may be embodied by a generally tubular member with an outer diameter generally smaller than the inner diameter of sliding sleeve 218. Thus, the shifting tool 222 may be selectively deployed downhole to close the active ICD 212 via axially displacing the sliding sleeve 218 such that aperture(s) 220 are no longer in radial alignment with port(s) 216, e.g., toward the left in the figure. To this end, the shifting tool 222 may include one or more radially protrusive portions 224 (e.g., that can be selectively extended in a radial direction so that they protrude as shown) that can physically engage a portion of sliding sleeve 218 (e.g., an annular end face portion thereof, toward the right in the figure) and pull or push the sliding sleeve 218 so that it displaces axially.

In view of the above, it is clear that passive ICDs are generally less cumbersome and costly to design and install, but they are much less effective in reducing water production once production performance is assessed (e.g., including a determination of the relative proportions of oil and water components). Apart from a draconian option of isolating the entire well section below an ICD that is found to be contributing water (and isolating that ICD itself), e.g., via one or more isolation packers as indicated at 110 in FIG. 1, it is possible to disable or deactivate individual ICDs selectively, i.e., take remedial measures to block any (radially inward) fluid flow into the ICD. This can be done by installing a casing patch (e.g., an expandable steel patch) at the ICD, which blocks the inflow of reservoir fluid (i.e., that includes an undesirable proportion of water). While this still permits other ICDs to contribute to hydrocarbon production, the patch does not amount to an easily reversible installation. Thus, the patch would need to be milled out, or removed via a similarly invasive procedure, if reservoir conditions change to a point that reopening the ICD would be warranted.

In view of the challenges outlined above, one or more embodiments broadly contemplated herein involve a remedial sleeve component for use with passive ICDs, as part of a system for modifying one or more passive ICDs. Such a sleeve component may include a pass-through sliding sleeve with a shifting profile that permits isolating a passive ICD that may be contributing to high water production. By way of merely illustrative example, such a sleeve component can be formed mainly from high quality stainless steel with elastomer outer portions at least at both axial ends of the sleeve, to help provide a sealing effect at the axial ends.

At the same time, in accordance with one or more embodiments, an internal portion of the remedial sleeve component can include a profile which permits selective opening and closing, similarly to the operation of an active ICD. Thus, a shifting tool, as normally used with active ICDs, can also be used here to selectively open and close one or more ports or openings as needed. (Thus, that or an analogous actuation tool can serve as part of a system for modifying one or more passive ICDs.) Thus, the admission of reservoir fluid through the passive ICD can effectively be controlled in response to monitored reservoir conditions, while obviating the disadvantages from conventional solutions as discussed above (e.g., isolating large sections of a well completion or adding a permanent steel patch that would be difficult/expensive to mill to "reopen" the passive ICD).

As such, the disclosure now turns to working examples of a remedial sliding sleeve, and processes for its installation and use, in accordance with one or more embodiments as described and illustrated with respect to FIGS. 3-7. It should be understood and appreciated that these merely represent illustrative examples, and that a great variety of possible implementations are conceivable within the scope of embodiments as broadly contemplated herein.

Figure 3:
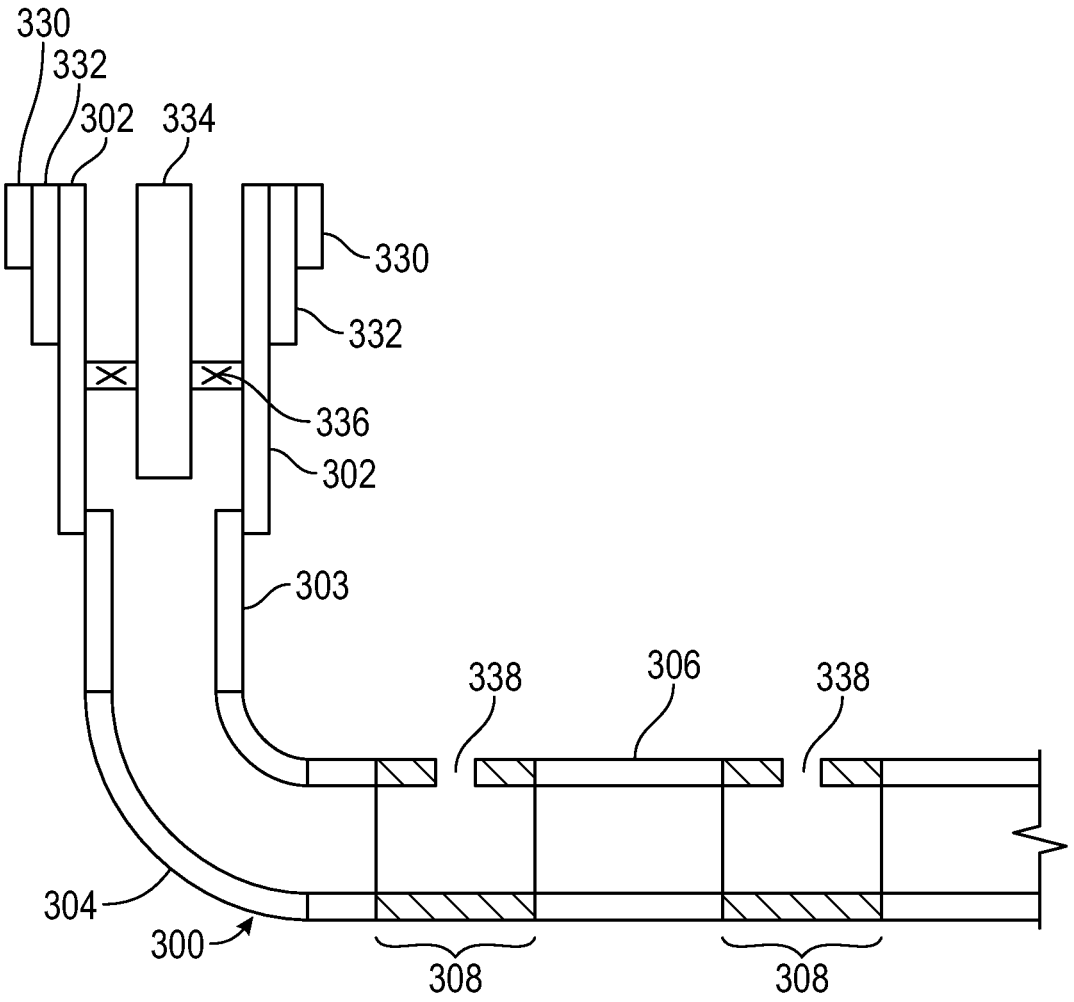
FIG. 3 schematically illustrates, in cross-sectional elevational view, a wellbore completion with passive ICDs initially installed, in accordance with one or more embodiments.

In accordance with one or more embodiments, FIG. 3 schematically illustrates, in cross-sectional elevational view, a wellbore completion with passive ICDs initially installed. As shown, and as generally known, the wellbore completion may include several nested casings of progressively longer length and smaller overall diameter. Thus, illustrated in FIG. 3, in such a sequence, are a conductor casing 330, a surface casing 332 and a production casing 302. Also, a base pipe 300 in the form of a production liner is suspended from inside the production casing 302 and extends downwardly therefrom. The base pipe 300 may include an initial downhole section 303 (from the production casing 302 downward) which is generally vertical in orientation, a transition section 304 which is generally curved (shown here with relatively tight radii of curvature merely for illustrative purposes) and a lateral section 306 which is generally horizontal.

In accordance with one or more embodiments, as is also generally known, production tubing 334 may be nested (with ample radial clearance) within the production casing 302, and a production packer 336 may be disposed to bridge the annular space between production tubing 334 and production casing 302. Also illustrated in FIG. 3 are two passive ICDs 308, axially spaced apart from one another in the lateral section 306 of base pipe 300. As discussed heretofore, each passive ICD 308 may essentially form a constituent portion of the base pipe 300 itself, each also including one or more apertures 338 which permit the throughflow of fluid from a hydrocarbon reservoir into an interior portion of base pipe 300, in a generally radially inward direction. As noted heretofore, the apertures 338 continually remain open to such throughflow.

Figure 4:
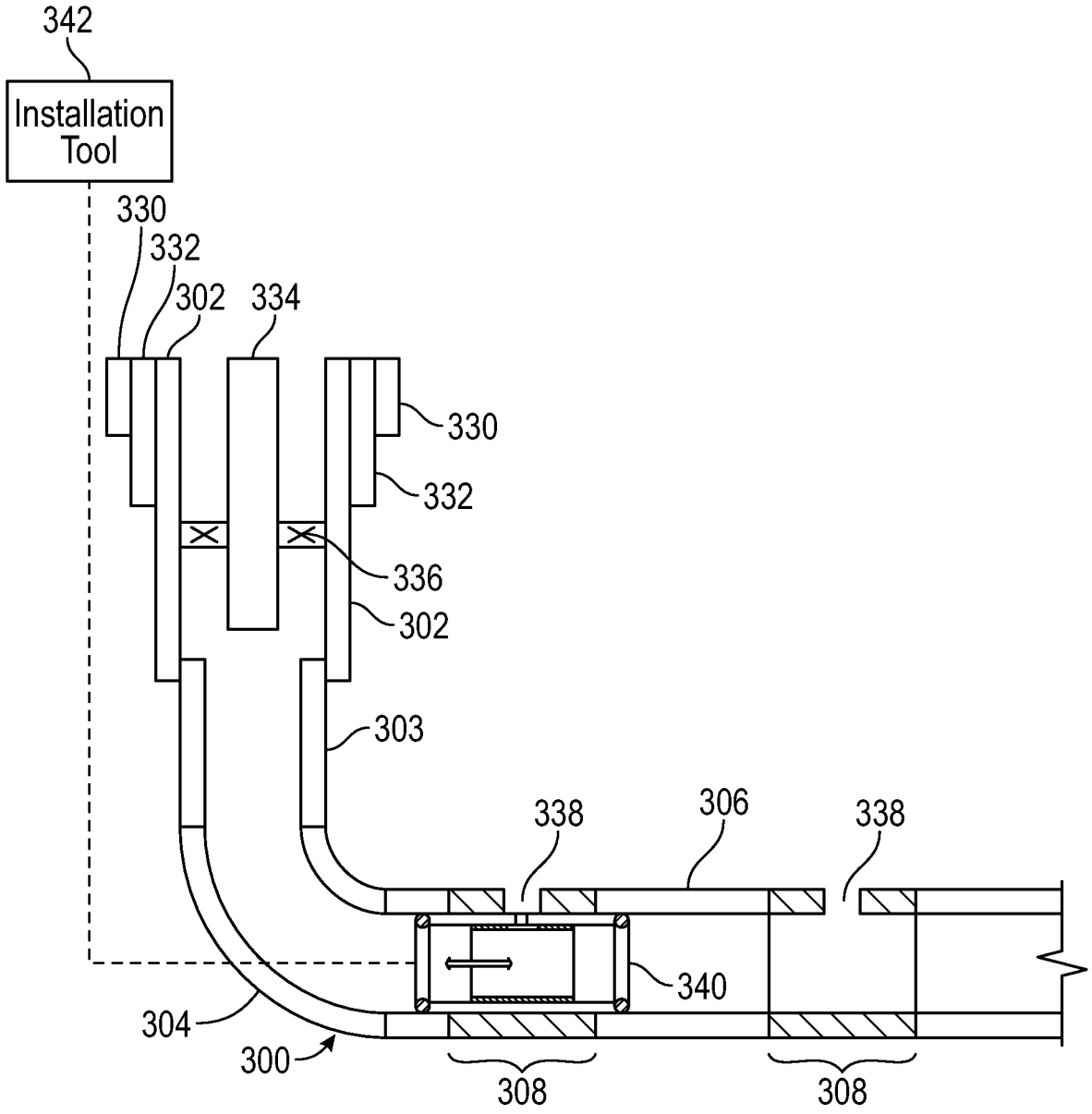
FIG. 4 is essentially the same view as FIG. 3, but additionally showing the installation of a remedial sleeve component, in accordance with one or more embodiments.

FIG. 4 is essentially the same view as FIG. 3, but additionally showing the installation of a remedial sleeve component 340, in accordance with one or more embodiments. Generally, the remedial sleeve component 340 can essentially serve to functionally convert a passive ICD 308 into an active ICD. It may be installed along a generally axial direction with respect to the base pipe 300 (and as generally indicated by the curved arrow), via the assistance of an installation tool 342. The installation tool 342 may be embodied, by way of illustrative example, by coiled tubing or a wireline, which may propagate (or move) the remedial sleeve component 340 in a generally axially direction downhole until it reaches the passive ICD 338 where it is to be installed. Such propagation may be effected with tractor assistance, and thus it should be appreciated that no rig assistance would normally be necessary for the purpose. (It should also be understood that production tubing 334 may be removed temporarily for the purpose of propagating the remedial sleeve component 340 downhole.)

Figure 5:
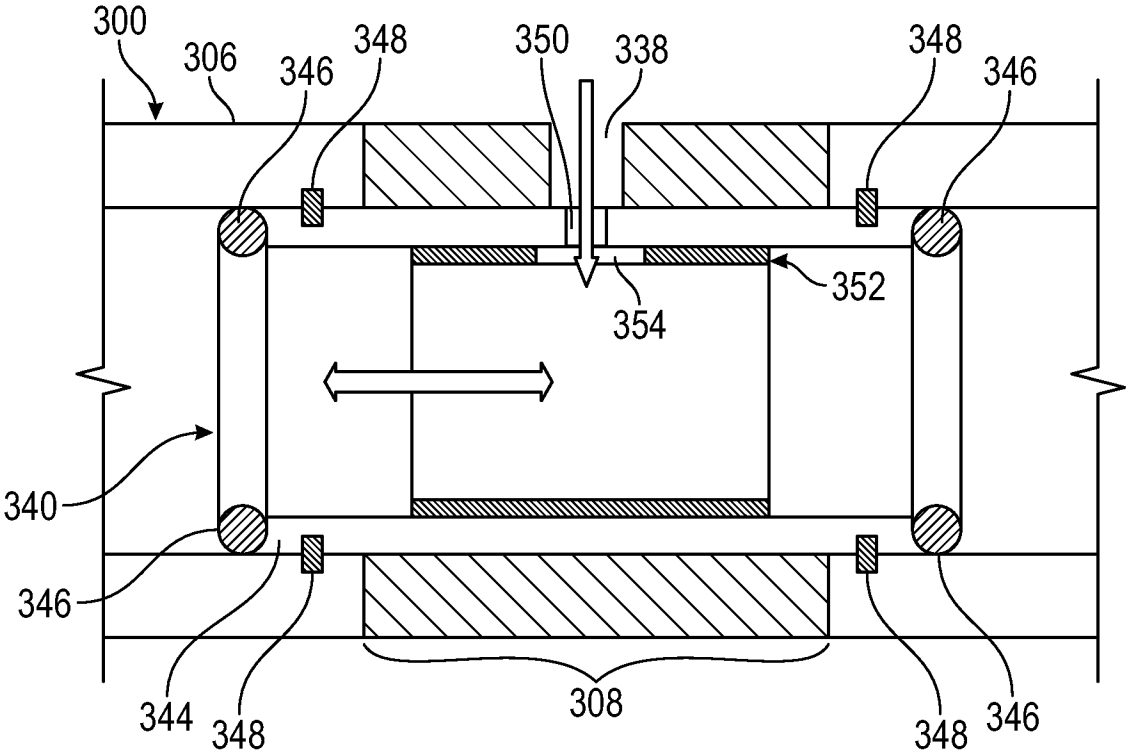
FIG. 5 provides a close-up view of a portion of the base pipe from FIG. 4, showing the remedial sleeve component in an "open" position, in accordance with one or more embodiments.

FIG. 5 provides a close-up view of a portion of the base pipe from FIG. 4, showing the remedial sleeve component 340 in an "open" position, in accordance with one or more embodiments. As shown, remedial sleeve component 340 includes a main body 344 which is generally cylindrical in shape and, at its terminal axial ends (left and right in the figure, respectively), sealing portions 346. The sealing portions 346 may be in the form of sealing rings as shown, and formed from an elastomer (e.g., nitrile rubber or "Teflon"; "Teflon" is a registered trademark of The Chemours Company of Wilmington, Del.). When the remedial sleeve component 340 is nested within the passive ICD 308 (and base pipe 300) at a desired axial position, it may be fixed in place via the use of anchors 348. Four such anchors 348 are illustrated in FIG. 5, toward the terminal axial ends of main body 344, but it should be understood that any suitable number of such anchors 348 may be employed. By way of illustrative and non-restrictive example, the anchors 348 may be embodied by anchors similar to those employed conventionally for bridge plugs and packers.

In accordance with one or more embodiments, one or more ports 350 (e.g., throughholes or apertures) may be provided in main body 344; one such port 350 is shown in FIG. 5 for the purposes of illustration. When radially aligned with aperture 338 of passive ICD 308 and if otherwise uninhibited or unblocked, the port 350 provides fluid communication between a surrounding hydrocarbon reservoir and an interior of remedial sleeve component 340 (and thus of the base pipe 300 itself). However, a closing portion may also be provide to selectively open or close the one or more ports 350, effectively to transform the passive ICD 308 into an active ICD once the remedial sleeve component 340 is installed.

As such, indicated at 352 is a sliding sleeve component in accordance with one or more embodiments, which slides along an axial direction of the remedial sleeve component 340 and which may serve as such a closing portion. Sliding sleeve component 352 is generally cylindrical in shape and may be mounted to reciprocate axially (e.g. with the assistance of a tool as described further below), and as shown by the horizontal double arrow. Sliding sleeve component 352 may be mounted with respect to main body 344 in essentially any suitable manner, e.g., via compatible protrusions and axial grooves disposed at the internal cylindrical surface of main body 344 and the external cylindrical surface of sliding sleeve component 352; thus, it could be mounted similarly to a sliding sleeve of a conventional active ICD such as that shown in FIG. 2.

In accordance with one or more embodiments, sliding sleeve component 352 also includes one or more apertures 354; one such aperture 354 is shown in FIG. 5 for the purposes of illustration. Thus, when radially aligned with one or more ports 350 of the main body 344 as shown, it facilitates fluid communication between the surrounding hydrocarbon reservoir and an interior of sliding sleeve component 352, remedial sleeve component 340 and base pipe 300, to facilitate the propagation of hydrocarbons through the base pipe 300 and toward the surface. Thus, the remedial sleeve component 340 may be considered to be in an "open" position in FIG. 5.

In accordance with one or more embodiments, as alternatives to a sliding sleeve component 352, other types of closing portions may be utilized. For instance, one or more valves with ports may be disposed in the main body 344, with suitable connections made to a surface or downhole control system to permit opening and closing of the valves.

Figure 6:
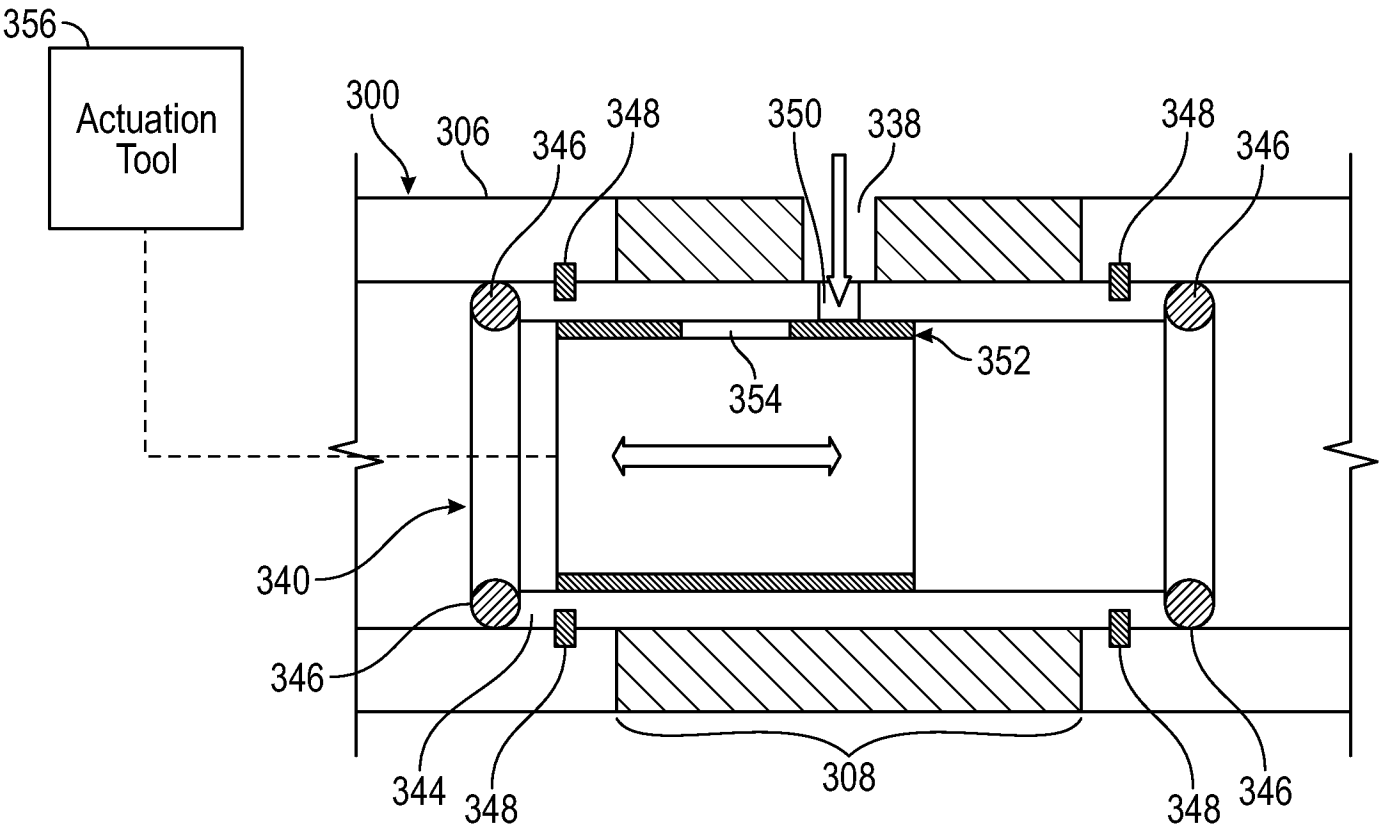
FIG. 6 is essentially the same view as FIG. 5, but showing the remedial sleeve component in a "closed" position, in accordance with one or more embodiments.

FIG. 6 is essentially the same view as FIG. 5, but showing the remedial sleeve component 340 in a "closed" position, in accordance with one or more embodiments. Thus, as shown, the sliding sleeve component 352 has been axially shifted toward the left in the figure, such that the one or more apertures 354 are no longer radially aligned with the one or more ports 350; thus, no fluid (such as hydrocarbons and/or water) can now flow into the interior of base pipe 300. Additionally, the sealing rings 346 will ensure that a flow of fluid into the base pipe 300 is further prevented when indeed the one or more ports 350 are closed as shown in FIG. 6.

In accordance with one or more embodiments, the aforementioned axial shifting may be effected by a suitable actuation tool 356; by way of illustrative and non-restrictive example, the actuation tool 356 may be embodied by a shifting tool similar to that described and illustrated with respect to FIG. 2 (and indicated there at 222). Such a shifting tool may also be appropriately dimensioned to facilitate its deployment into the interior of remedial sleeve component 352 and sliding sleeve component 352.

Figure 7:
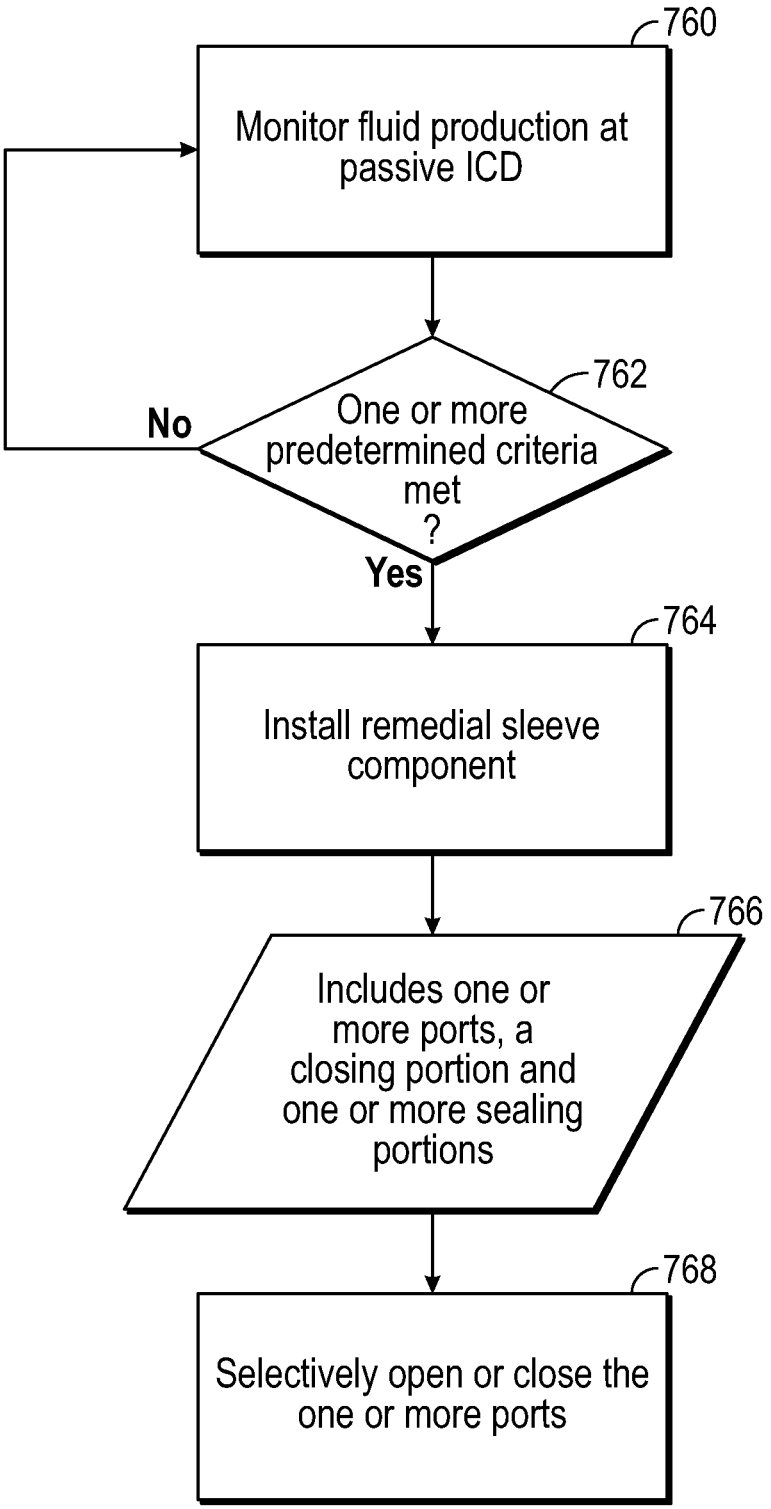
FIG. 7 illustrates a flowchart of a method in accordance with one or more embodiments.

FIG. 7 illustrates a flowchart of a method in accordance with one or more embodiments. Thus, as shown, in a first general step (760), fluid production may be monitored at a passive ICD such as either of those indicated at 308 in FIG. 3. Such monitoring can be undertaking in essentially any suitable manner, e.g., in a manner as known conventionally for monitoring the production of hydrocarbons and water at downhole locations of a completed well. If one or more predetermined criteria are not met (762), such as water production over a predetermined threshold, then such monitoring may continue as hydrocarbons continue to be produced by the well. However, if the one or predetermined criteria indeed are met, then a remedial sleeve component (such as that indicated at 340 in FIG. 4) may be installed (764) for the passive ICD as discussed herein. As also discussed herein, the remedial sleeve component may include (766): one or more ports which permit throughput of fluid into the base pipe; a closing portion which selectively opens and closes the one or more ports; and one or more sealing portions, which prevent a flow of fluid into the base pipe when the one or more ports are closed. The one or more ports, closing portion and one or more sealing portions may be embodied, respectively, by the port(s) 350, the sliding sleeve component 352, and sealing rings 346 as described and illustrated herein with respect to FIGS. 5 and 6.

In accordance with one or more embodiments, the one or more ports may be selectively opened or closed responsive to one or more additional predetermined criteria (768). Such criteria may derive from general monitoring of water production in a base pipe; thus, while a remedial sleeve component may first be installed with that the one or more ports are initially closed (e.g., as shown in FIG. 6), the one or more ports may then be selectively opened (e.g., as shown in FIG. 5) if general water production in the base pipe (e.g., as measured from other ICDs) is determined to be below a predetermined threshold.

Among the advantages afforded by one or more embodiments is an ease of installation. While active ICDs typically need to be installed using a rig (as part of the general well completion process), no rig is required for installing a pass-through remedial sleeve component as contemplated herein. For instance, the remedial sleeve component can be installed merely by way of coiled tubing or a wireline, with tractor assistance.

It can be appreciated from the foregoing that, in accordance with one or more embodiments, there is broadly contemplated herein the permanent installation of a remedial sleeve component, with a shiftable profile, to effectively convert an installed passive ICD to a nominally active ICD. The remedial sleeve component is installed to be nested within a passive ICD and can be opened and closed as desired via a shifting tool. Thus, the ensemble essentially behaves as an active ICD, but can be installed very easily as a retrofit with requiring the use of a rig.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A method comprising:

monitoring fluid production at a passive inflow control device (ICD) installed in a base pipe in a wellbore;

responsive to monitored fluid production meeting one or more predetermined criteria, installing a remedial sleeve component for the passive ICD, the remedial sleeve component comprising:

a main body;

one or more ports provided in the main body and which permit throughput of fluid into the base pipe;

a closing portion which selectively opens and closes the one or more ports; and one or more sealing portions, which prevent a flow of fluid into the base pipe when the one or more ports are closed, wherein installing the remedial sleeve component includes propagating the remedial sleeve component downhole until reaching the passive ICD; and selectively opening or closing the one or more ports responsive to one or more additional predetermined criteria.

2. The method according to claim 1, wherein monitoring fluid production includes monitoring water production at the passive ICD.

3. The method according to claim 2, wherein the remedial sleeve component is installed responsive to water production above a predetermined threshold.

4. The method according to claim 1, wherein:

the one or more ports are closed when the remedial sleeve component is installed; and the one or more ports are selectively opened responsive to the additional predetermined criteria.

5. The method according to claim 1, wherein the one or more ports permit a flow of fluid in a generally radially inward direction with respect to the base pipe.

6. The method according to claim 1, wherein installing includes nesting the remedial sleeve component radially within the base pipe and the passive ICD.

7. The method according to claim 1, wherein the closing portion includes one or more sliding components which selectively open and close the one or more ports.

8. The method according to claim 7, wherein the one or more sliding components comprise a sliding sleeve component which slides along an axial direction of the remedial sleeve component.

9. The method according to claim 1, wherein the main body of the remedial sleeve component is generally cylindrical in shape.

10. The method according to claim 9, wherein:

the main body has first and second axial ends; and the one or more sealing portions include a sealing ring disposed at each of the first and second axial ends.

11. The method according to claim 10, wherein the sealing rings are formed from elastomer.

12. A system for modifying a passive inflow control device (ICD) installed in a base pipe in a wellbore, said system comprising:

a remedial sleeve component comprising:

a main body;

one or more ports provided in the main body and which permit throughput of fluid in a generally radially inward direction;

a closing portion which selectively opens and closes the one or more ports; and one or more sealing portions, which prevent a flow of fluid into the base pipe when the remedial sleeve component is installed in the base pipe and the one or more ports are closed;

an actuation tool which deploys into the wellbore to actuate the closing portion to selectively open and close the one or more ports; and an installation tool which deploys into the wellbore to install the remedial sleeve component at a passive ICD in the wellbore, via propagating the remedial sleeve component downhole until reaching the passive ICD.

13. The system according to claim 12, wherein the closing portion includes one or more sliding components which selectively open and close the one or more ports.

14. The system according to claim 13, wherein the one or more sliding components comprise a sliding sleeve component which slides along an axial direction of the remedial sleeve component.

15. The system according to claim 12, wherein the main body of the remedial sleeve component is generally cylindrical in shape.

16. The system according to claim 15, wherein:

the main body has first and second axial ends; and the one or more sealing portions include a sealing ring disposed at each of the first and second axial ends.

17. The system according to claim 16, wherein the sealing rings are formed from elastomer.

18. The system according to claim 12, wherein the installation tool includes a tractor component configured to move the remedial sleeve to the passive ICD.

19. A method comprising:

monitoring water production at a passive inflow control device (ICD) installed in a base pipe in a wellbore;

responsive to monitored water production above a predetermined threshold, installing a remedial sleeve component for the passive ICD via nesting the remedial sleeve component radially within the base pipe and the passive ICD, the remedial sleeve component comprising:

a main body;

one or more ports provided in the main body and which permit throughput of fluid into the base pipe, in a generally radially inward direction with respect to the base pipe;

a closing portion which selectively opens and closes the one or more ports; and one or more sealing portions, which prevent the throughput of fluid into the base pipe when the one or more ports are closed, wherein installing the remedial sleeve component includes propagating the remedial sleeve component downhole until reaching the passive ICD; and selectively opening or closing the one or more ports responsive to one or more additional predetermined criteria.

* * * * *